US005582308A

United States Patent [19]

Kishi et al.

[11] Patent Number: 5,582,308

[45] Date of Patent: Dec. 10, 1996

[54] CAP HAVING A PILFER-PROOF PACKAGING MECHANISM

[75] Inventors: Takao Kishi; Hiroyuki Nakamura, both of Koto-ku, Japan

[73] Assignee: Yoshino Kogyosho, Co., Ltd., Tokyo, Japan

[21] Appl. No.: 397,267

[22] PCT Filed: Jul. 18, 1994

[86] PCT No.: PCT/JP94/01174

§ 371 Date: Mar. 15, 1995

§ 102(e) Date: Mar. 15, 1995

[87] PCT Pub. No.: WO95/03224

PCT Pub. Date: Feb. 2, 1995

[30] Foreign Application Priority Data

Jul. 19, 1993 [JP] Japan ..... 5-178267
Jun. 10, 1994 [JP] Japan ..... 6-129235

[51] Int. Cl.[6] ..... B65D 41/34
[52] U.S. Cl. ..... 215/252
[58] Field of Search ..... 215/252

[56] References Cited

U.S. PATENT DOCUMENTS

| | | | |
|---|---|---|---|
| 3,937,348 | 2/1976 | Guala | 215/252 |
| 4,530,436 | 7/1985 | Weidmer | 215/246 |
| 4,700,859 | 10/1987 | Gregory | 215/252 |
| 4,746,026 | 5/1988 | Leonhardt . | |
| 4,775,064 | 10/1988 | Baxter . | |
| 4,919,285 | 4/1990 | Roof et al. | 215/230 |
| 5,080,246 | 1/1992 | Hayes | 215/252 |
| 5,135,123 | 8/1992 | Nairn et al. | 215/252 |
| 5,328,044 | 7/1994 | Röhrs et al. . | |

FOREIGN PATENT DOCUMENTS

| | | |
|---|---|---|
| 25814/62 | 6/1964 | Australia . |
| 30868/67 | 1/1970 | Australia . |
| 42126/72 | 11/1973 | Australia . |
| 63488/73 | 6/1975 | Australia . |
| 68160/87 | 8/1987 | Australia . |
| 75099/91 | 11/1991 | Australia . |
| 14319 | 8/1980 | European Pat. Off. . |
| 61-47350 | 3/1986 | Japan . |
| 62-251358 | 11/1987 | Japan . |
| 63-96046 | 4/1988 | Japan . |
| 55-107653 | 8/1990 | Japan . |
| WO91/17090 | 11/1991 | WIPO . |

*Primary Examiner*—Stephen Cronin
*Attorney, Agent, or Firm*—Oliff & Berridge

[57] ABSTRACT

A cap is fixed to a cylindrical neck of a vessel and is provided with a pilfer-proof packaging mechanism that can definitely verify whether the cap has been opened. The cap includes a resin cap body formed in a cylindrical shape with a top and a resin pilfer-proof ring that is fixed to a bottom portion of the cap body so as to be exposed from the cap body. The pilfer-proof ring is cut at a portion to be a spiral-like strip once the cap has been opened.

15 Claims, 10 Drawing Sheets

CAP HAVING A PILFER-PROOF PACKAGING MECHANISM

BACK GROUND OF THE INVENTION

The present invention relates to a cap with a pilfer-proof packaging mechanism which is fitted to a cylindrical neck of a vessel.

Some of caps which are fitted to cylindrical necks of vessels, respectively, are provided with pilfer-proof packaging mechanisms. The pilfer-proof packaging mechanism is a mechanism for visually verifying whether a cap has not been opened yet or has been opened.

A conventional cap provided with a pilfer-proof packaging mechanism comprises an integrally molded product in which a cap body and a ring portion with catching pieces disposed below the cap body are connected each other with thin bridges at some portions on the peripheral direction thereof. When the cap is screwed on a cylindrical neck of a vessel, the catching pieces of the ring portion catch a flange of the cylindrical neck of the vessel so that the cap is set to the vessel.

By turning the cap body in an opening direction, the bridges are broken so that the cap body can be detached from the cylindrical neck of the vessel and the ring portion stays at the cylindrical neck.

In the conventional cap as mentioned above, the ring portion stays at the cylindrical neck keeping its shape in a tubular configuration when taking off the cap body. Therefore, as the cap body is screwed again on the cylindrical neck after taking off the cap body once, the cap body and ring portion seem like integrated when seen from a distance, that is, the cap sometime looks like as an sealed cap.

SUMMARY OF THE INVENTION

It is an object of the present invention to provide a cap with a pilfer-proof packaging mechanism which allows for sure verification of whether the cap has been opened or has not been opened yet.

A cap according to the present invention is a cap, made of resin, to be screwed down to a cylindrical neck of a vessel, and has a pilfer-proof packaging mechanism which can verify whether the cap has not been opened yet or has been opened.

The cap comprises a resin cap body formed in a cylindrical shape with a top, and a resin pilfer-proof ring fixed to a bottom portion of the cap body. The cap body is provided with an internal thread on an upper inner surface thereof. The pilfer-proof ring comprises (a) an annular member and (b) elastic catching pieces.

(a) The annular member comprises a plurality of blocks which are disposed in an annular shape and are connected to the adjacent one by first connecting members. One of the first connecting members has a section area which is smaller than that of the other first connecting members so as to make the first connecting member frangible.

The annular member is partially bonded to the cap body at a plurality of portions on the circumferential direction thereof. To bond the annular member to the cap body, ultrasonic welding or other manners may be employed. A bonded portion disposed at an opening direction side of the frangible one of the first connecting members has a bonding area is larger than that of the other bonded portions so as to make bonding strength to the cap body larger than that of the other portions.

(b) The elastic catching pieces are disposed inside said annular member. The elastic catching pieces extend diagonally inwardly toward a top of the cap body. End portions of the elastic catching pieces are elastic-deformable to elongate the diameter of a circle formed by all of the elastic catching pieces and are able to catch a flange disposed below the external thread disposed on the cylindrical neck of the vessel.

The pilfer-proof ring may be bonded to the cap body by ultrasonic welding.

The frangible one of the first connecting members is provided with a section decreased portion decreasing the vertical sectional area thereof so that the frangible one of the first connecting members can be easily broken.

The blocks of said annular member have standing walls, to be inserted inside a lower portion of the cap body, respectively, so that the pilfer-proof ring can be easily fixed to the cap body.

The standing walls may be separated to each other, or the standing walls adjacent to each other may be connected each other by second connecting members at upper portions thereof to make all of the standing walls integral. In this case, the second connecting members are formed to be frangible.

The second connecting members are provided with section decreased portions decreasing the sectional areas thereof. Thereby, even when the second connecting members are broken during bonding the pilfer-proof ring to the cap body by ultrasonic welding, the second connecting members are broken only at the section decreased portions so as to prevent them from separating from the standing walls.

It is preferable in safety that the section decreased portions are disposed on ends at the opening direction side of the second connecting member because the fragments of the second connecting members are prevented from pricking user's hand when pulling the pilfer-proof ring to remove it after opening the cap.

It is preferable that the annular member of said pilfer-proof ring is provided with protrusions as connections to said cap body on the upper surface of the annular member, and that the cap body is provided with a positioning annular groove to which said protrusions of the pilfer-proof ring are engaged on the lower bottom, thereby preventing slippage of the axial center between the cap body and the pilfer-proof ring during the ultrasonic welding.

The major diameter of the external thread of the vessel is substantially same as the outer diameter of the flange so that an lower portion of the cap (where the pilfer-proof ring is accommodated) has a small outer diameter.

It should be noted that the number of the blocks and the number of the elastic catching pieces are not specified.

When the cap as structured above is screwed down to the cylindrical neck of the vessel, the elastic catching pieces of the pilfer-proof ring get over the flange with the diameter, of a circle formed by all of the elastic catching pieces, elongating by the elasticity thereof. After getting over the flange, the elastic catching pieces contract to recover the normal diameter so that the tips thereof catch the flange. After the elastic catching pieces catch the flange, to remove the cap from the vessel, there is no other way but to pull the pilfer-proof ring off the cap body.

In this state, by turning the cap in the opening direction, the cap body is applied with rotational force and with force in the upward direction by the function of screw, while the pilfer-proof ring is prevented from moving upwardly because the elastic catching pieces catch the flange of the vessel. As a result of this, the connections between the cap body and the pilfer-proof ring are broken and the one of the first connecting members, which is previously set to be frangible, is broken. The other first connecting members and the bonded portion, of which bonding area is larger than that of the other bonded portions, are not broken.

In case of providing the second connecting members, the second connecting members are broken at substantially same when the connections between the cap body and the pilfer-proof ring are broken.

Therefore, the pilfer-proof ring becomes a band-like strip of which one end is connected to the cap body and thereby can get over the flange of the cylindrical neck of the vessel. The pilfer-proof ring is pulled by the cap body to pass outside the flange of the vessel in a spiral-like shape. The pilfer-proof ring is removed from the vessel with the cap body.

After removing the cap, the pilfer-proof ring may be separated from the cap body by pulling the pilfer-proof ring to brake the connection having the large bonding area. The cap body can be screwed to the cylindrical neck again without separating the pilfer-proof ring, there is no chance to mistake it for a sealed cap because the pilfer-proof ring has been in the spiral shape, not in the annular shape and it is impossible to restore it to the original annular shape.

DETAILED DESCRIPTION OF PREFERRED EMBODIMENTS

Hereinafter, preferred embodiments of the present invention will be described with reference to the drawings.

[First Embodiment]

A cap according to the first embodiment of the present invention will now be described with reference to FIGS. 1 through 12.

Figure 1:
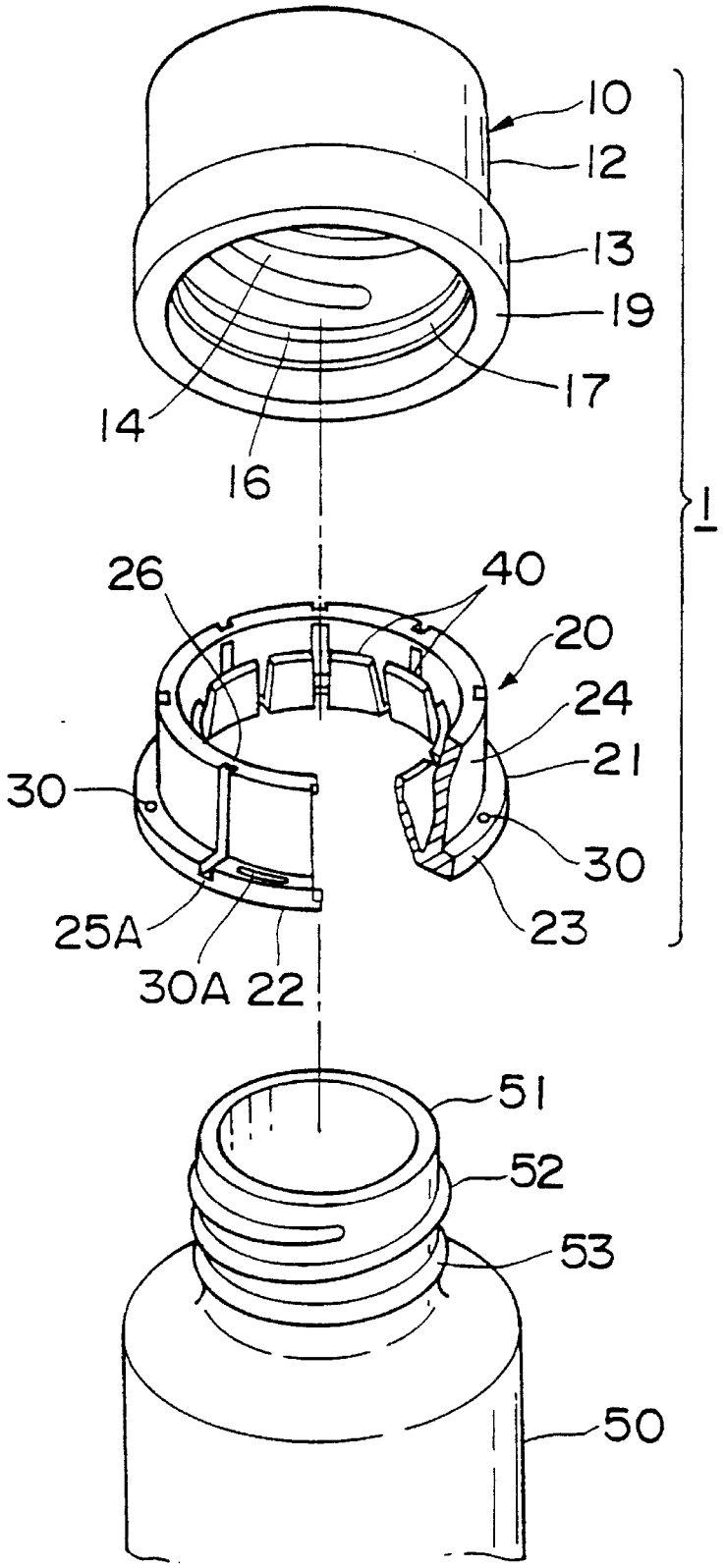
FIG. 1 is an exploded perspective view of a cap according to a first embodiment of the present invention.
Figure 2:
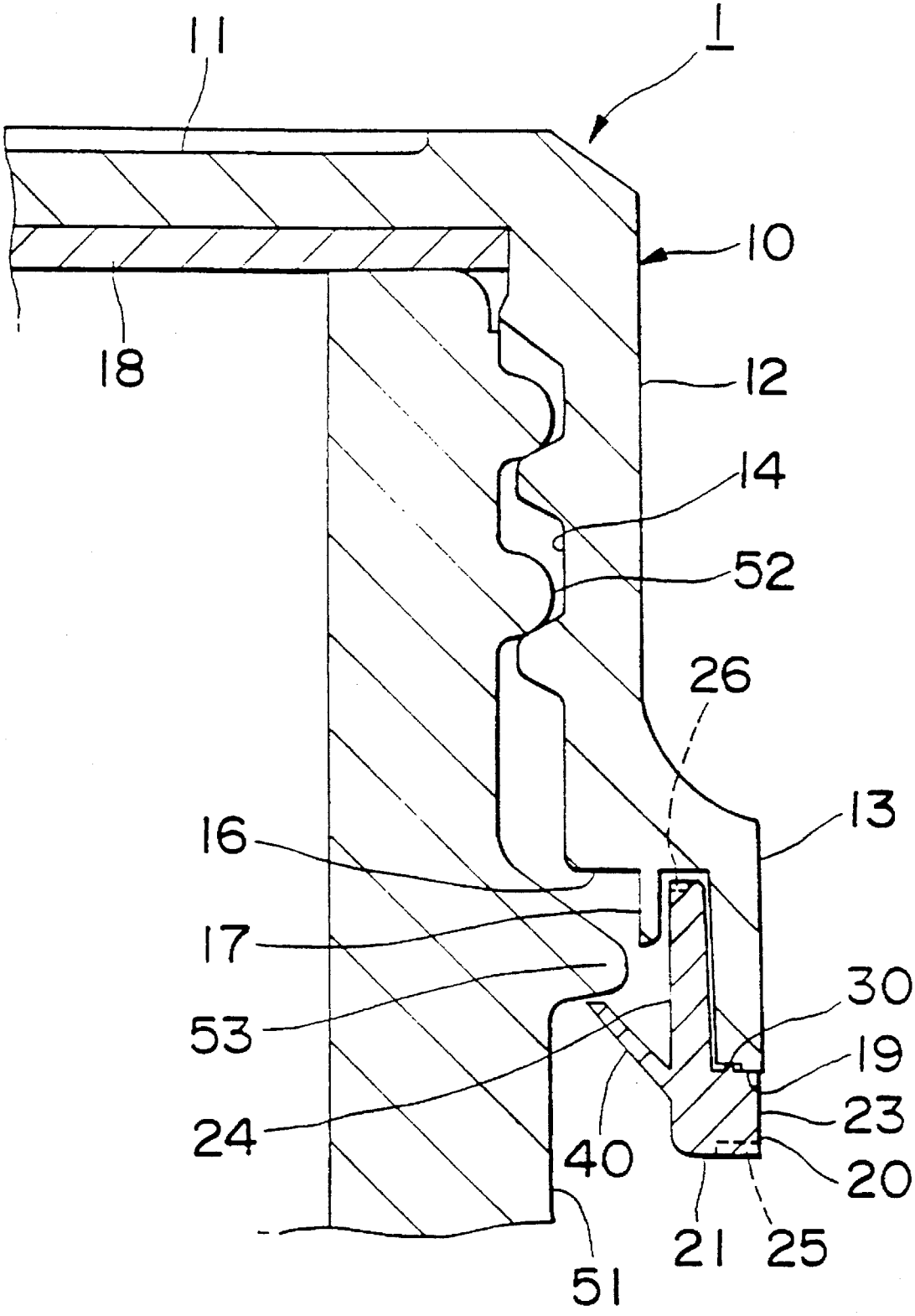
FIG. 2 is a sectional view of the cap in an assembled state according to the first embodiment of the present invention.

FIG. 1 is an exploded perspective view of a cap according to the present invention and a vessel to which the cap is fixed and FIG. 2 is a sectional view of the cap in the assembled state.

A vessel 50 includes a cylindrical neck 51 which is provided with an external thread 52 on a right-handed screw and provided with a ring-like flange 53 on the peripheral surface thereof. The outer diameter of the flange 53 is larger than a major diameter of the external thread 52.

Figure 12:
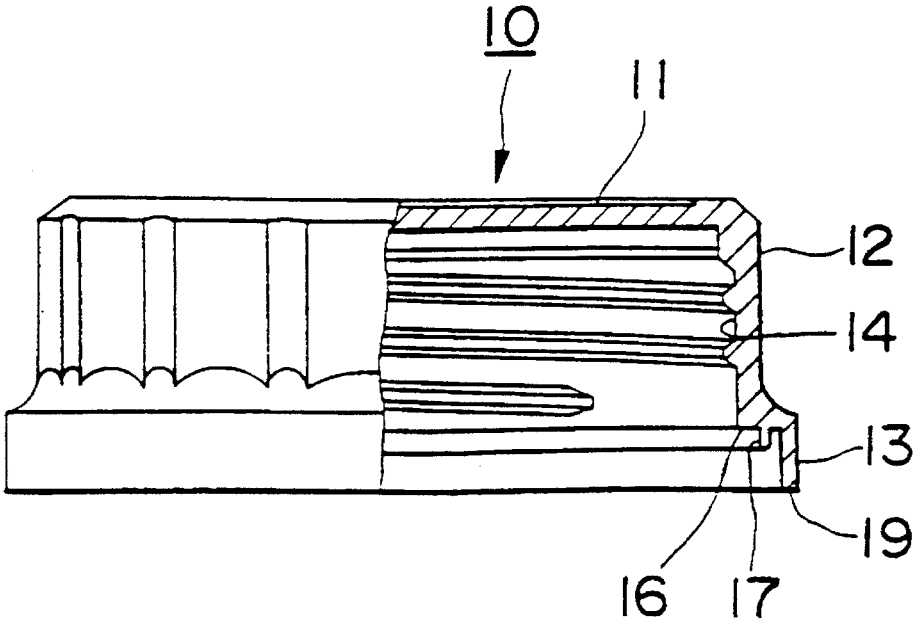
FIG. 12 is a front view showing the cap body according to the first embodiment of the present invention, the cap body is partially cut away for explanation.

The cap 1 comprises a cap body 10 made of resin and a pilfer-proof ring 20 made of resin which is fixed to the cap body 10. FIG. 12 is a partially cutaway view of the cap body 10. The cap body 10 comprises a cylindrical member having a top 11. The upper portion of the cylindrical member is a small-diameter portion 12 and the lower portion thereof is a large-diameter portion 13 having a diameter larger than the small-diameter portion 12.

The small-diameter portion 12 is provided with an internal thread 14 forming a female screw on the inner surface thereof to engage the external thread 52 of the vessel 50. An inner ring 17 formed in an annular shape extends downwardly from the stage 16 between the inner surface of the small-diameter portion 12 and the inner surface of the large-diameter portion 13. A gasket 18 is fit inside the top 11 of the cap body 10.

The pilfer-proof ring 20 comprises an annular body 21 and elastic catching pieces 40.

Figure 3:
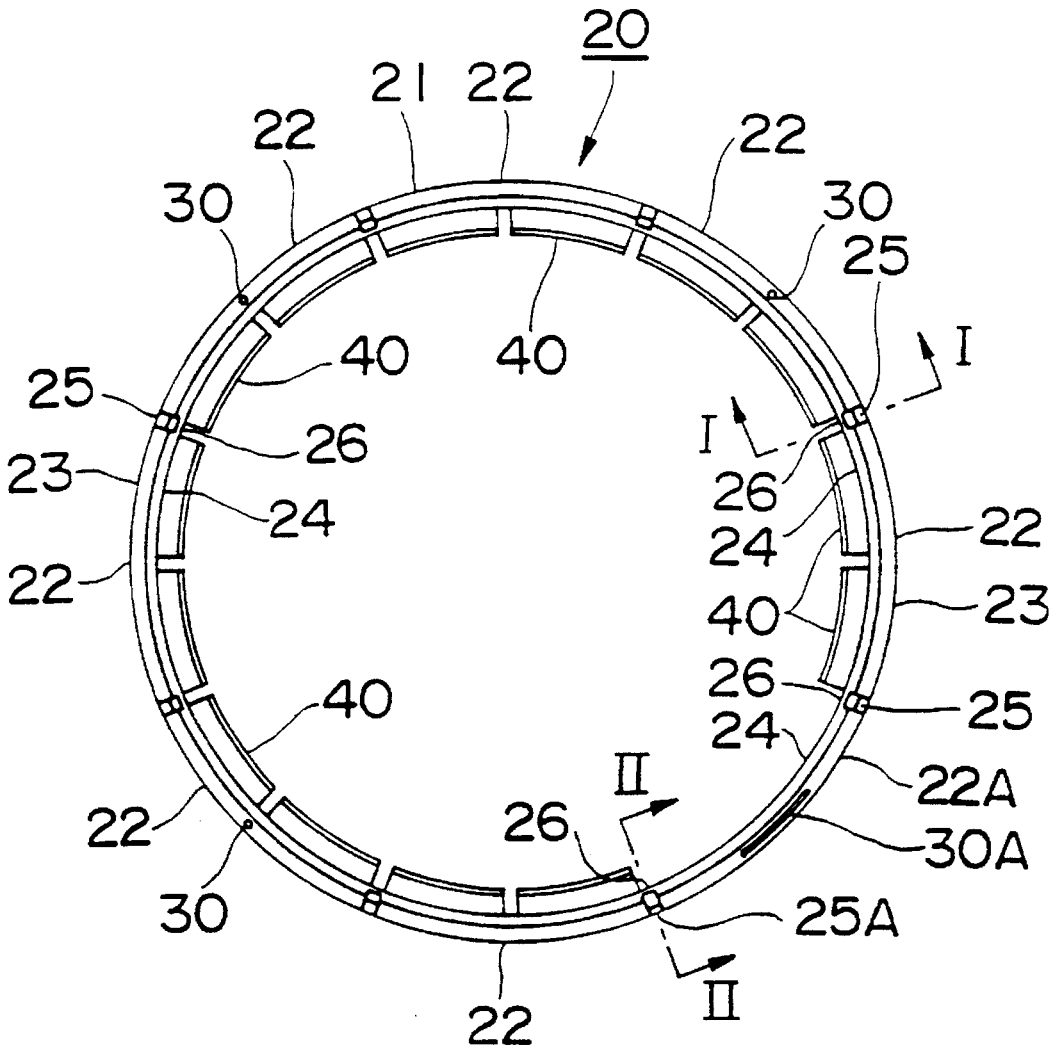
FIG. 3 is a plan view of a pilfer-proof ring according to the first embodiment of the present invention.
Figure 4:
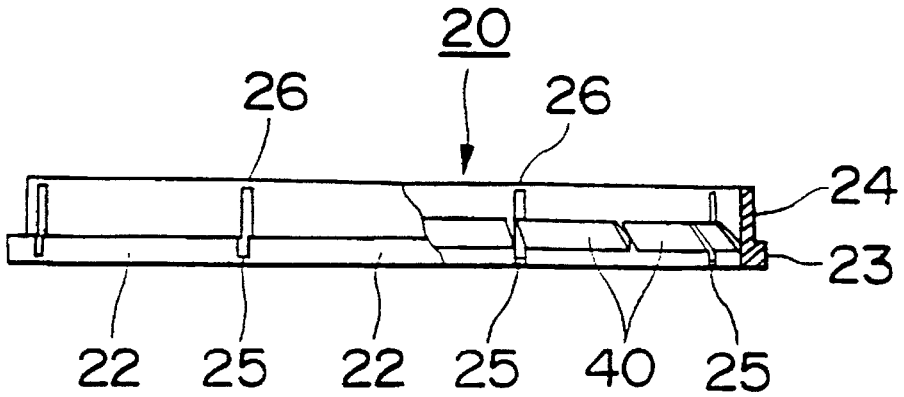
FIG. 4 is a front view showing the pilfer-proof ring according to the first embodiment of the present invention, the pilfer-proof ring is partially cut away for explanation.
Figure 5A:
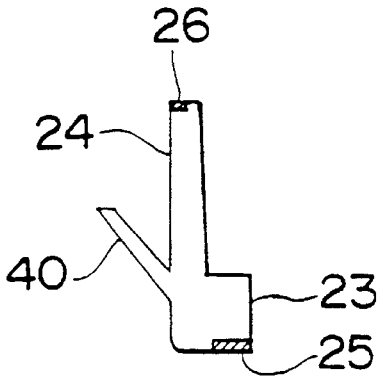
FIG. 5(A) is a sectional view taken along the line I—I of FIG. 3.
Figure 5B:
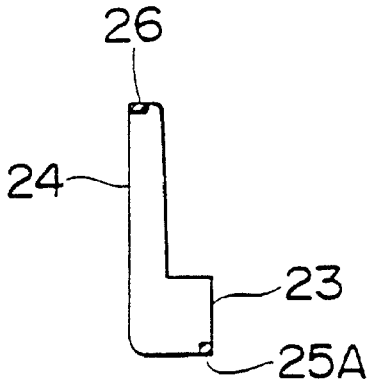
FIG. 5(B) is a sectional view taken along the line II—II of FIG. 3.
Figure 6:
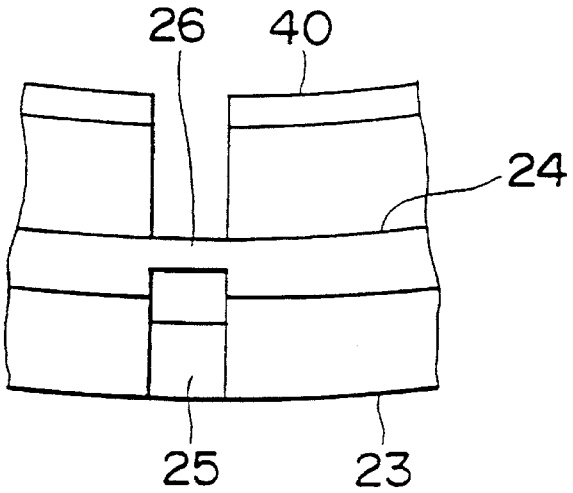
FIG. 6 is an enlarged plan view of a part of the pilfer-proof ring according to the first embodiment of the present invention.
Figure 7:
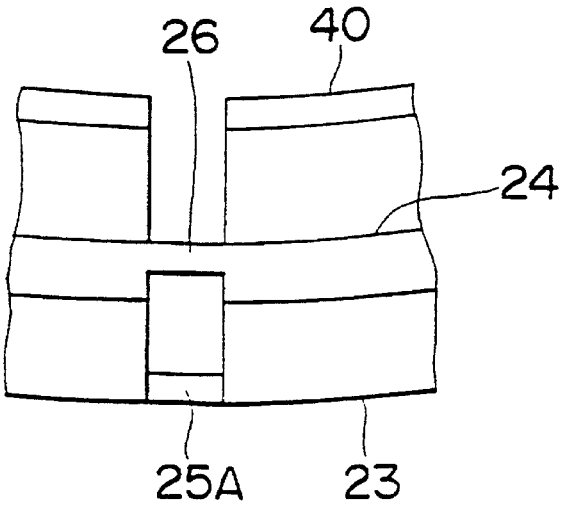
FIG. 7 is an enlarged plan view of a part of the pilfer-proof ring according to the first embodiment of the present invention.
Figure 8:
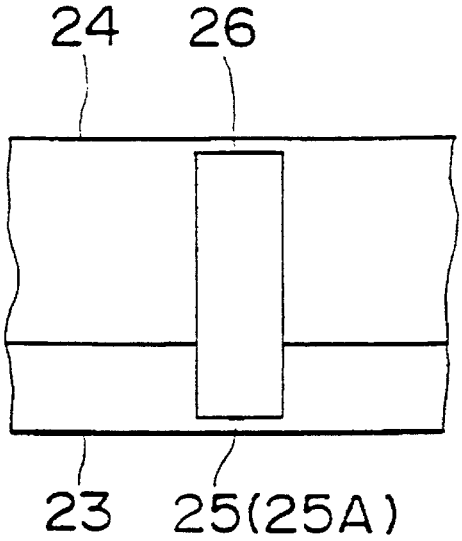
FIG. 8 is an enlarged front view of a part of the pilfer-proof ring according to the first embodiment of the present invention.
Figure 9:
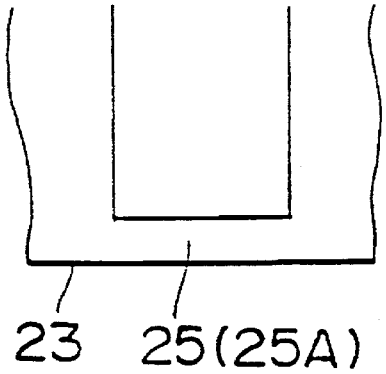
FIG. 9 is an enlarged front view of a first connecting member in the pilfer-proof ring according to the first embodiment of the present invention.
Figure 10:
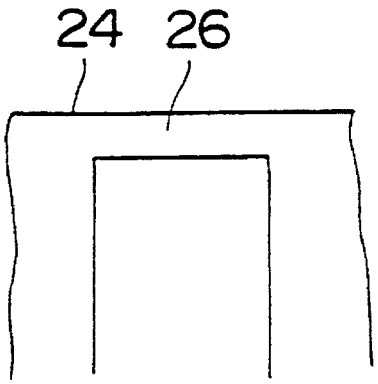
FIG. 10 is an enlarged front view of a second connecting member of the pilfer-proof ring according to the first embodiment of the present invention.

FIG. 3 is a plan view of the pilfer-proof ring 20, FIG. 4 is a front view of the pilfer-proof ring 20 which is partially cut away, FIGS. 5(A) and 5(B) are a sectional view taken along the line I—I of FIG. 3 and a sectional view taken along the line II—II of FIG. 3, respectively, FIG. 6 is a plan view of a part corresponding to that shown in FIG. 5 (A), FIG. 7 is a plan view of a part corresponding to that shown in FIG. 5(B), FIG. 8 is a front view of a part corresponding to that shown in FIGS. 5(A) and 5(B), FIG. 9 is an enlarged front view centered on a first connecting member 25 (25A), and FIG. 10 is an enlarged front view centered on a second connecting member 26.

The annular body 21 comprises eight blocks 22 (one of which is designated by the numeral 22A) formed in a circular arc shape which are connected to form an annular shape. Seven blocks 22 except one block 22A are each provided two elastic catching pieces 40.

The blocks 22 and 22A are each formed in a L-like shape in its longitudinal section and each have a base 23 and a standing wall 24. As shown in FIG. 5(A) and FIG. 6, the blocks 22 and 22A adjacent to each other are connected each other by the first connecting member 25, the sectional area of which is small, at a bottom and outer portion of the base 23 and by the second connecting member 26, the sectional area of which is small, at a upper and inner portion of the standing wall 24. The sectional area of the first connecting member 25 is larger than that of the second connecting member 26.

The sectional area of the first connecting member 25A between the block 22A and the block 22, which is disposed at the left side of the block 22A when they are seen from above, is smaller than those of the other first connecting members 25 and is not larger than those of the second connecting members 26 as shown in FIG. 5(B) and FIG. 7.

The first connecting member 25, 25A and the second connecting members 26 each are not varied in sectional area along its whole length.

The elastic catching pieces 40 extend diagonally and upwardly from the inner surfaces of the bases 23 of the blocks 22, respectively. The inner diameter of the annular shape formed by the elastic catching pieces 40 is larger than the major diameter of the external thread 52 of the vessel 50 and slightly smaller than the outer diameter of the flange 53.

The bases 23 are provided with protrusions 30, 30A for ultrasonic welding, which protrude from the upper surfaces thereof at four portions on the periphery of a circle formed by all of the bases 23. As shown in FIG. 3, one of four protrusions is provided on the block 22A having no elastic catching piece 40. The protrusion 30A on the block 22A is formed to have a long length along the peripheral direction thereof so as to have a large welding area to the cap body 10.

The other three protrusions 30 are disposed at intervals of 90 degrees along the peripheral direction with the origin at the protrusion 30A. The three protrusions 30 are each formed substantially in a conical shape and each have a length along the peripheral direction which is quite shorter than that of the protrusion 30A so as to have a small area welding to the cap body 10. In this embodiment, though the protrusions 30 are each formed substantially in a conical shape, it is not limited to this shape.

Figure 11:
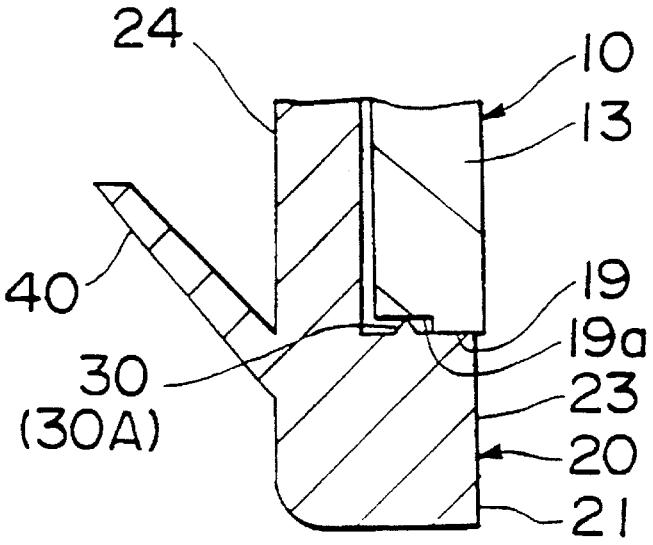
FIG. 11 is an enlarged vertical sectional view of a connection between a cap body and the pilfer-proof ring of the cap according to the first embodiment of the present invention.

As shown in FIG. 2 and FIG. 11, the pilfer-proof ring 20 as structured above is fixed to the cap body 10 by inserting the standing walls 24 between the inner surface of the large-diameter portion 13 of the cap body 10 and the inner ring 17, and bonding the four protrusions 30, 30A, by ultrasonic welding, to an inside surface (lower end bottom surface) 19*a* of a staged bottom surface 19 of the large-diameter portion 13 of the cap body 10, respectively, with the base 23 being exposed from the cap body 10. That is, the pilfer-proof ring 20 is partially connected with the cap body 10 through the protrusions 30, 30A as connections.

The protrusion 30A has the length along the peripheral direction, which is longer than that of the other protrusions 30 to make the welding area larger so that the connecting strength of the connection by the protrusion 30A is larger than that of the connection by the other protrusions 30. While, the other three protrusions 30 are connected to the cap body by spot joints which are relatively easily broken.

To fix the cap 1 to the cylindrical neck 51 of the vessel 50, the cap 1 is screwed down to the cylindrical neck 51. Before the cylindrical neck 51 is closed, the elastic catching pieces 40 of the pilfer-proof ring 20 come in contact with the flange 53 of the vessel 50. At this moment, the elastic catching pieces 40 get over the flange 53 with the diameter, of a circle formed by all of the elastic catching pieces 40, elongating by the elasticity thereof. After getting over the flange 53, the elastic catching pieces 40 contract to recover the normal diameter so that the tips thereof catch the flange 53. Immediately after this, the top surface of the cylindrical neck 51 is pushed to be in contact with the gasket 18 of the cap 1, thereby closing the cylindrical neck 51. FIG. 2 shows this state.

As mentioned above, the cap 1 can be easily fixed to the vessel 50.

The pilfer-proof ring 20 is integrated into the cap body 10 with its shape being annular, thereby easily verifying that the cap 1 is in its non-opened (sealed) state.

The cap 1 is opened as follows. Even when the cap 1 is turned in the opening direction, the pilfer-proof ring 20 can not move upwardly because the elastic catching pieces 40 keep in contact with the flange 53 of the vessel 50.

As the cap 1 is turned in the opening direction against the resistance by the flange 53, the cap body 10 is applied with rotational force and with force in the upward direction by the function of screw. Because of these forces, the connections by the protrusions 30 of the connections between the cap body 10 and the pilfer-proof ring 20 are broken. At the nearly same time, the first connecting member 25A and the second connecting members 26 of the pilfer-proof ring 20 are broken. The other connecting members 25 and the connection by the protrusion 30A having the large welding area are not broken at this point.

As a result of this, the pilfer-proof ring 20 becomes a band-like strip of which one end is connected to the cap body 10 at the connection by the protrusion 30A. In addition, it becomes flexible freely at the first connecting members 25 as flexible points. By the upward movement of the cap body 10, the pilfer-proof ring 20 passes outside the flange 53 of the vessel 50 in a spiral-like shape and rises the cylindrical neck 51 to be removed with the cap body 10 from the vessel 50.

After this, the pilfer-proof ring 20 may remain connected to the cap body 10 or may be separated from the cap body 10 by pulling the pilfer-proof ring 20 to break the connection by the protrusion 30A.

In the case where the pilfer-proof ring 20 is separated from the cap body 10, even when the cap body 10 is screwed down tight to the cylindrical neck 51 again, it can be verified that the cap 1 has been already opened because there is not the pilfer-proof ring 20.

While, even when the cap body 10 connected with the pilfer-proof ring 20 is screwed down tight to the cylindrical neck 51 again, it can be verified that the cap 1 has been already opened because the pilfer-proof ring 20 has became in the spiral shape, not in the annular shape and it is impossible to restore it to the original annular shape. Therefore, there is no chance to mistake it for that the cap 1 has not opened yet.

[Second Embodiment]

Figure 13:
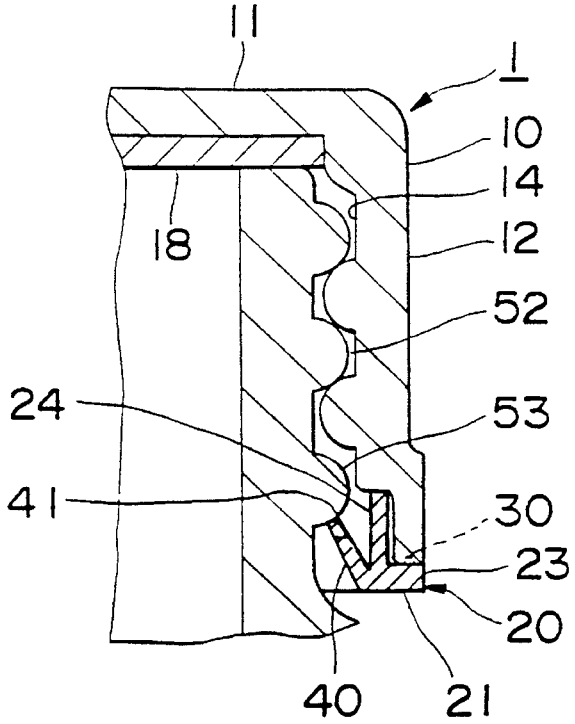
FIG. 13 is a sectional view of a cap in an assembled state according to a second embodiment of the present invention.

FIG. 13 shows the second embodiment of the cap 1 according to the present invention and is a vertical sectional view corresponding to FIG. 2. Hereinafter, the description will be made with regard to the differences between the cap 1 of the second embodiment and the cap 1 of the first embodiment and will be omitted in part by using same reference numerals for designating the same parts as that of the first embodiment.

The cap body 10 of the cap 1 of this embodiment does not have the inner ring 17. While, the outer diameter of the flange 53 of the vessel 50 is substantially same as the major diameter of the external thread 52.

In the cap 1 of the second embodiment as structured above, the outer diameter of an under portion of the cap body 1, to which the pilfer-proof ring 20 is fixed inside can be smaller than that of the first embodiment.

[Third Embodiment]

Figure 14:
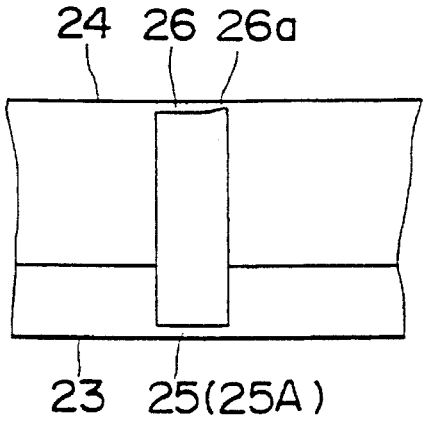
FIG. 14 is an enlarged front view of a part of the pilfer-proof ring according to a third embodiment of the present invention.
Figure 15:
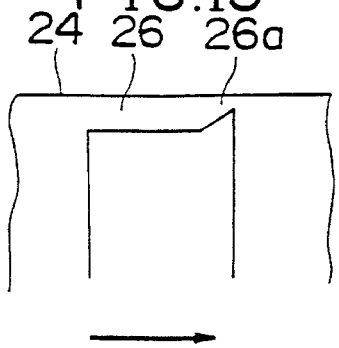
FIG. 15 is an enlarged front view of a second connecting member of the pilfer-proof ring according to the third embodiment of the present invention.

FIG. 14 and FIG. 15 are views showing the third embodiment of the cap 1 according to the present invention. FIG. 14 is a view corresponding to FIG. 8 and is a partial front view of the pilfer-proof ring 20. FIG. 15 is an elongated front view of one of second connecting members 26.

The pilfer-proof ring 20 of this embodiment is provided with section decreased portions 26*a* at the right ends of the second connecting members 26. The bottom surface of each section decreased portion 26*a* ascends in the opening direction to make gradually the sectional area at the right end of the second connecting member 26 smaller than that at the left side thereof.

As mentioned above, it is a differential point from the first embodiment that the second connecting members 26 are provided with the section decreased portions 26*a*. The other members are entirely same as those of the first embodiment.

The reason to provide with the section decreased portions 26*a* is as follows. When the pilfer-proof ring 20 is bonded to the cap body 10 by ultrasonic welding, the second connecting members 26 are sometimes broken by vibration occurred by the ultrasonic welding.

In this case, when the vertical sectional area of the second connecting member 26 is same along the entire length thereof as the first embodiment mentioned above, the both ends of the second connecting member 26 are broken so that the broken piece are sometimes separated from the pilfer-proof ring 20.

In case where the broken piece of the second connecting member 26 remains in the cap 1, there is a possibility that the broken piece drops from the cap 1 to enter into the vessel 50 when the cap is fixed to the vessel 50.

Figure 16:
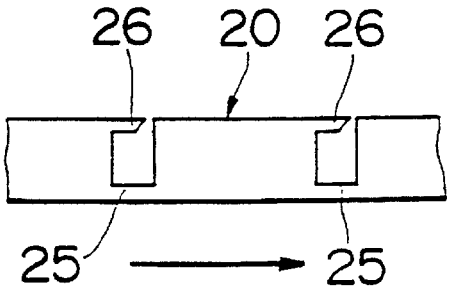
FIG. 16 is a partial front view showing a broken condition of the second connecting members of the pilfer-proof ring according to the third embodiment of the present invention.

However, by providing with the section decreased portions 26*a* to the second connecting members 26, even when the second connecting member 26 are broken during the ultrasonic welding, only the section decreased portions 26*a* are broken and the left side portions of the second connecting members 26 are not broken to remain connected to the standing wall 24. FIG. 16 is a schematic partial front view of the pilfer-proof ring 20 with the section decreased portions 26*a* being broken.

As a result of this, there is no chance that the second connecting members 26 drop from the pilfer-proof ring 20 and enter into the vessel 50.

Figure 17:
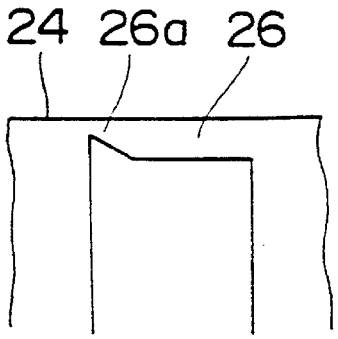
FIG. 17 is an enlarged front view showing a variation of the pilfer-proof ring according to the third embodiment of the present invention.
Figure 18:
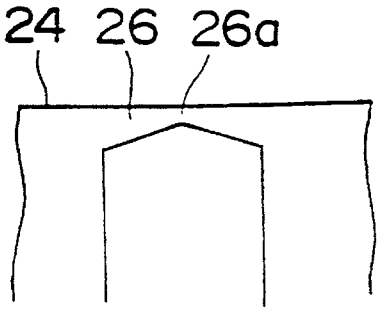
FIG. 18 is an enlarged front view showing a variation of the pilfer-proof ring according to the third embodiment of the present invention.

FIG. 17 and FIG. 18 show variations of the third embodiment and are elongated front views of second connecting members 26 corresponding to FIG. 15. FIG. 17 shows an example that the section decreased portion 26*a* is provided at the left end of the second connecting member 26 and FIG. 18 shows an example that the section decreased portion 26*a* is provided at the center of the second connecting member 26. Even when the section decreased portion 26*a* is disposed in such manners, the second connecting member 26 is impossible to drop from the pilfer-proof ring 20.

Figure 19:
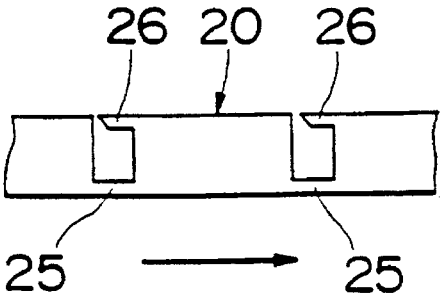
FIG. 19 is a partial front view showing a broken condition of the second connecting members of the variation of the pilfer-proof ring according to the third embodiment of the present invention.

FIG. 19 is a schematic partial front view of the pilfer-proof ring 20 after the section decreased portions 26*a* are broken in case where the section decreased portions 26*a* are provided at the left ends of the second connecting members 26.

Figure 20:
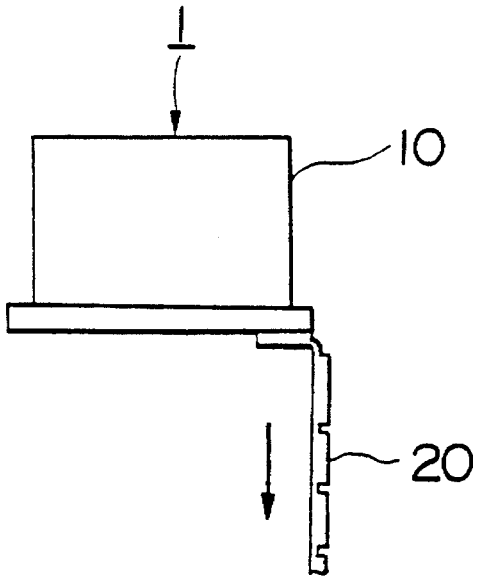
FIG. 20 is a view for explaining how the pilfer-proof ring is drawn out from the cap body of the cap according to the present invention.

To separate the pilfer-proof ring 20 from the cap body 10 after the cap fixed to the vessel 50 is opened, the pilfer-proof ring 20 is pulled in a direction of the arrow shown in FIG. 20. Therefore, it is preferable in safety that the section decreased portions 26*a* are provided at the right ends of the second connecting members 26 because the fragments of the second connecting members 26 are prevented from pricking user's hand.

[Fourth Embodiment]

Figure 21:
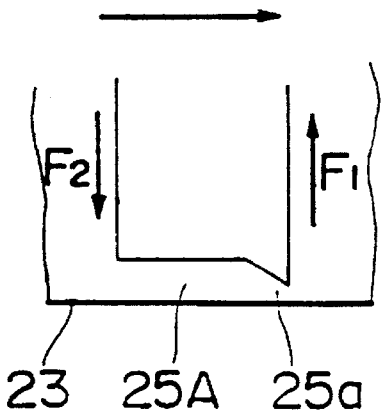
FIG. 21 is an enlarged front view of a first connecting member of a pilfer-proof ring according to a fourth embodiment of the present invention.

FIG. 21 shows the fourth embodiment of the cap 1 according to the present invention and is a front view of the first connecting member 25A of the pilfer-proof ring 20.

In the pilfer-proof ring 20 of this embodiment, the first connecting member 25A which is frangible is provided with a section decreased portion 25*a* at the right end thereof. The upper surface of the section decreased portion 25*a* slopes in the opening direction to make gradually the sectional area at the right end of the first connecting member 25 smaller than that at the left side thereof.

As mentioned above, it is a differential point from the first embodiment that the first connecting member 25A are provided with the section decreased portion 25*a* and the other members are entirely same as those of the first embodiment including the first connecting members 25 which are not be frangible.

By providing the section decreased portion 25*a*, the first connecting member 25A can be easily broken.

Figure 22:
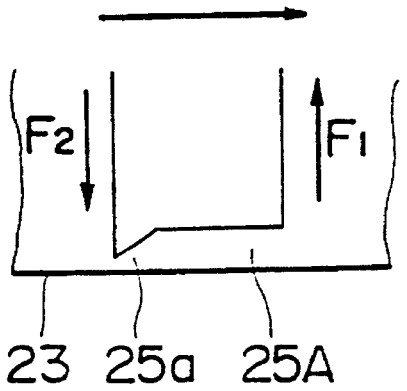
FIG. 22 is an enlarged front view of a first connecting member of a variation of the pilfer-proof ring according to the fourth embodiment of the present invention.

As shown in FIG. 22, it is also possible to provide the section decreased portion 25*a* at the left end of the first connecting portion 25A. However, the section decreased portion 25*a* is preferably provided at the right end as mentioned above. The reason is as follows.

In case where the external thread 52 of the vessel 50 and the internal thread 14 of the cap body 10 are formed to form a right-handed screw, when the cap 1 fixed to the vessel 50 is opened, the block 22*a* disposed on the right side of the first connecting member 25A is moved upwardly with the cap body 10 and the block 22 disposed on the left side of the first connecting member 25A catches the flange 53 of the vessel 50 so that the right end of the first connecting member 25A is applied with force in the upward direction as shown by the arrow F1 in this figure and the left end of the first connecting member 25A is applied with force in the downward direction as shown by the arrow F2 in this figure.

In this case, the section decreased portion 25*a* is easily broken when the section decreased portion 25*a* is provided at the right end of the first connecting member 25A as shown in FIG. 21, rather than when the section decreased portion 25*a* is provided at the left end as shown in FIG. 22.

[Fifth Embodiment]

As mentioned above, the second connecting members 26 are sometimes broken but sometimes not broken when the pilfer-proof ring 20 is bonded to the cap body 10 by ultrasonic welding. Considering the case where the second connecting members 26 are not broken during the ultrasonic welding, the second connecting members 26 are also preferably provided with section decreased portions to make the second connecting members 26 frangible.

Figure 23:
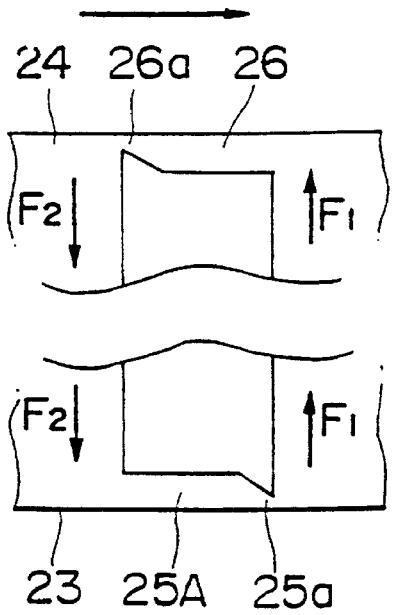
FIG. 23 is an enlarged front view of a first connecting member and a second connecting member in a pilfer-proof ring according to a fifth embodiment of the present invention.

In the fifth embodiment, the first connecting member 25A and the second connecting members 26 are provided with the section decreased portion 25*a* and the section decreased portions 26*a*, respectively. FIG. 23 shows the fifth embodiment and is an elongated front view of the first connecting member 25A and one of the second connecting members 26 of the pilfer-proof ring 20.

The upper surface of the section decreased portion 25*a* of the first connecting member 25A slopes in the opening direction and the bottom surface of the section decreased portion 26*a* slopes in the opening direction to make gradually both the sectional areas thereof small. The description about the other members of this embodiment will be omitted since the members are same as those of the first embodiment.

It is same as the case of the fourth embodiment that the section decreased portion 25*a* is preferably disposed at the right end of the first connecting member 25A.

However, in the fifth embodiment, the section decreased portion 26*a* is preferably disposed at the left end of the second connecting member 26. This is, as described above in the fourth embodiment, to make the section decreased portion 26*a* frangible because of the force F1, F2 applying to the both ends of the second connecting member 26.

[Sixth Embodiment]

Figure 24:
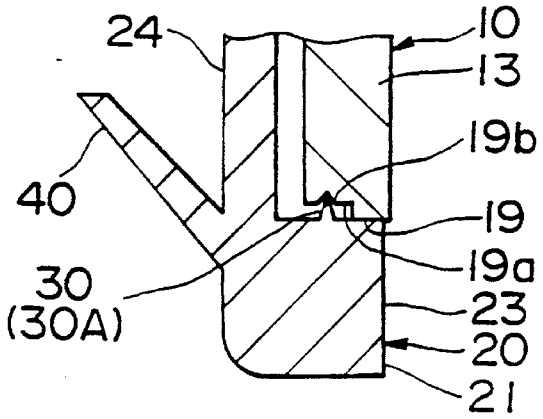
FIG. 24 is an enlarged vertical sectional view of a connection between a cap body and a pilfer-proof ring of a cap according to a sixth embodiment of the present invention.

FIG. 24 shows the sixth embodiment of the cap 1 according to the present invention and is an elongated sectional view of the connection between the cap body 10 and the pilfer-proof ring 20 (corresponding to FIG. 11 of the first embodiment).

In the first embodiment, as shown in FIG. 11, the inside surface 19*a* of the staged bottom surface of the large-diameter portion 13 of the cap body 10 is flat and the four protrusions 30, 30A of the pilfer-proof ring 20 are bonded to the inside surface 19*a* by ultrasonic welding, with the four protrusions of the pilfer-proof ring 20 keeping pricking the inner surface 19*a*.

Further, there is a clearance along the radial direction between the cap body 10 and the pilfer-proof ring 20 for assembly.

However, in case of the structure as the first embodiment, there is a possibility of slippage of the axial center between the cap body 10 and the pilfer-proof ring 20 due to the vibration occurred by the ultrasonic welding. The slippage of the axial center sometimes causes inconveniences to users in fixing the cap 1 to the vessel 50 and in opening the cap 1.

In the sixth embodiment, as shown in FIG. 24, the inner surface 19*a* of the cap body 10 is provided with an annular groove 19*b* for positioning the protrusions 30, 30A, to which the protrusions 30, 30A can be engaged. The annular groove 19*b* is disposed entirely along the circumference of the inner surface 19*a*.

As the protrusions 30, 30A are bonded to the inner surface 19*a* by ultrasonic welding with the protrusions 30, 30A being engaged with the annular groove 19*b*, there is no chance to occur slippage of the axial center between the cap body 10 and the pilfer-proof ring 20 because they are not able to move in the radial direction during the ultrasonic welding.

Figure 25:
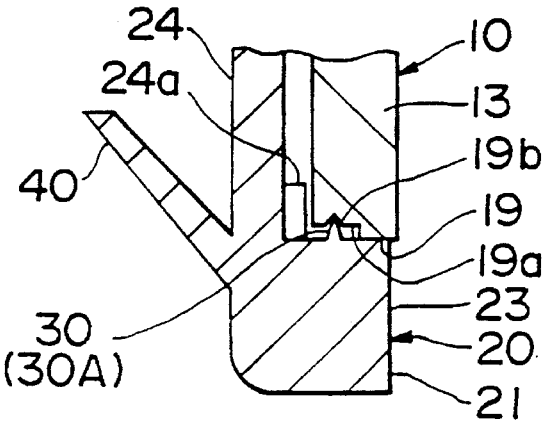
FIG. 25 is an enlarged vertical sectional view of a connection between a cap body and a pilfer-proof ring in a variation of the cap according to the sixth embodiment of the present invention.

FIG. 25 shows a variation of the sixth embodiment. The standing wall 24 of the pilfer-proof ring 20 is provided with supplementary positioning projections 24*a*. The supplementary positioning projections 24*a* are disposed at intervals along the periphery of the standing wall 24 to make a quite small clearance between the outer surfaces of the supplementary positioning projections 24*a* and the inner surface of the large-diameter portion 13 of the cap body 10.

INDUSTRIAL APPLICABILITY

As for the cap according to the present invention, considering the circumstances mentioned above, it can be definitely verified whether the cap has not been opened yet or has been opened. Therefore, the cap according to the present invention is effectively used as a cap for a vessel which is filled with foodstuff such as juice and soft drinks.

We claim:

1. A cap, made of resin, to be screwed down to a cylindrical neck of a vessel, said cap having a pilfer-proof packaging mechanism that can verify whether the cap has been opened, wherein:

a resin cap body formed in a cylindrical shape with a top is provided with an internal thread adapted to be fitted to an external thread disposed on the cylindrical neck of the vessel; a resin pilfer-proof ring is fixed to a bottom portion of the cap body so as to be exposed from the cap body; and the resin pilfer-proof ring comprises:

(a) an annular member formed by connecting a plurality of blocks by first connecting members, one of the first connecting members having a section area that is smaller than respective section areas of the other first connecting members so as to make the one connecting member frangible, the annular member being bonded to the cap body at a plurality of bonded portions in a circumferential direction thereof, one of said bonded portions being disposed along a surface of the annular member facing the cap body in a vicinity of said one frangible connecting member, said one of said bonded portions in the vicinity of said one frangible connecting member having a bonding area that is larger than that of the other bonded portions; and (b) elastic catching pieces disposed inside said annular member and extending diagonally inwardly toward a top of the cap body, the elastic catching pieces being resiliently deformable in a radial direction and being engageable with a flange disposed below the external thread disposed on the cylindrical neck of the vessel.

2. A cap according to claim 1, wherein the resin pilfer-proof ring is bonded to the cap body by ultrasonic welding.

3. A cap according to claim 1, wherein said one frangible connecting member has a vertical sectional area that is less than that of the other first connecting members.

4. A cap according to claim 1, wherein the blocks of said annular member have standing walls insertable inside a lower portion of the cap body, respectively.

5. A cap according to claim 4, wherein said standing walls adjacent each other are connected to each other by second connecting members at upper portions thereof.

6. A cap according to claim 5, wherein said second connecting members are provided with section decreased portions decreasing the vertical sectional areas thereof.

7. A cap according to claim 6, wherein said section decreased portions are disposed along respective outer circumferential surfaces of the second connecting members.

8. A cap according claim 1 wherein the annular member of said resin pilfer-proof ring is provided with protrusions for connecting to said cap body on the upper surface of the annular member, and the cap body is provided with a positioning annular groove to which said protrusions of the resin pilfer-proof ring are engaged.

9. A cap according to claim 1, wherein a major diameter of the external thread of the vessel is substantially equal to an outer diameter of the flange.

10. A pilfer-proof packaging mechanism for determining whether a container cap has been opened, said container cap including a cap body being threadedly engageable with external threads formed on a cylindrical neck of a container, said pilfer-proof packaging mechanism comprising:

an annular member formed by connecting a plurality of blocks by first connecting members, one of the first connecting members having a section area that is smaller than respective section areas of the other first connecting members so as to make the one connecting member frangible, the annular member being bonded to the cap body at a plurality of bonded portions thereof, one of said bonded portions being disposed along a surface of said annular member facing the cap body in a vicinity of said one frangible connecting member, said one of said bonded portions in the vicinity of said one frangible connecting member having a bonding area that is larger than that of the other bonded portions; and elastic catching pieces disposed inside said annular member and extending diagonally inwardly toward a top of the cap body, the elastic catching pieces being resiliently deformable in a radial direction and being catchably engageable with a flange disposed below the external threads disposed on the cylindrical neck of the container.

11. A pilfer-proof packaging mechanism for determining whether a container cap has been opened, said pilfer-proof packaging mechanism comprising:

an annular member formed by connecting a plurality of blocks by first connecting members, one of the first connecting members having a section area that is smaller than respective section areas of the other first connecting members so as to make the first connecting member frangible, the annular member being bonded to the cap at a plurality of bonded portions thereof, one of said bonded portions being disposed along an upper surface of said annular member facing the cap in a vicinity of said one frangible connecting member, said one of said bonded portions in the vicinity of said one frangible connecting member having a bonding area that is larger than that of the other bonded portions; and elastic catching pieces disposed inside said annular member and extending diagonally inwardly toward a top of the cap body.

12. A pilfer-proof packaging mechanism according to claim 11, wherein the one frangible connecting member has a vertical sectional area that is less than that of the other first connecting members.

13. A pilfer-proof packaging mechanism according to claim 11, wherein the blocks of said annular member have standing walls insertable inside a lower portion of the cap.

14. A pilfer-proof packaging mechanism according to claim 13, wherein said standing walls adjacent each other are connected to each other by second connecting members at upper portions thereof.

15. A pilfer-proof packaging mechanism according to claim 11, wherein the annular member is provided with protrusions for detachably connecting the cap to the annular member.

* * * * *